US010661941B2

(12) United States Patent
Genender et al.

(10) Patent No.: US 10,661,941 B2
(45) Date of Patent: May 26, 2020

(54) CONTAINER HAVING IMPROVED COMPRESSION STRENGTH

(71) Applicant: Medline Industries, Inc., Mundelein, IL (US)

(72) Inventors: Alan Genender, Northbrook, IL (US); Yogesh Wadhera, Vernon Hills, IL (US)

(73) Assignee: MEDLINE INDUSTRIES, INC., Mundelein, IL (US)

( * ) Notice: Subject to any disclaimer, the term of this patent is extended or adjusted under 35 U.S.C. 154(b) by 0 days.

(21) Appl. No.: 15/966,716

(22) Filed: Apr. 30, 2018

(65) Prior Publication Data

US 2018/0257808 A1 Sep. 13, 2018

Related U.S. Application Data

(63) Continuation of application No. 14/247,543, filed on Apr. 8, 2014, now abandoned.

(51) Int. Cl.

| | |
|---|---|
| ***B65D 5/36*** | (2006.01) |
| ***B65D 5/44*** | (2006.01) |
| ***B65D 5/24*** | (2006.01) |
| ***B65D 5/68*** | (2006.01) |
| ***B65D 5/66*** | (2006.01) |

(52) U.S. Cl.

CPC ..... *B65D 5/3678* (2013.01); *B65D 5/248* (2013.01); *B65D 5/443* (2013.01); *B65D 5/6697* (2013.01); *B65D 5/68* (2013.01)

(58) Field of Classification Search

CPC ..... B65D 5/241; B65D 5/3678

USPC ..... 229/186, 187, 117.06, 117.05, 117.01, 229/177, 117, 117.14, 117.17; 428/12

See application file for complete search history.

(56) References Cited

U.S. PATENT DOCUMENTS

| | | | | |
|---|---|---|---|---|
| 284,179 A | | 9/1883 | Buckinham | |
| 715,026 A | | 12/1902 | Crawford | |
| 959,261 A | * | 5/1910 | Reber | B65D 5/566 229/122.32 |
| 1,061,531 A | | 5/1913 | Emmons | |

(Continued)

FOREIGN PATENT DOCUMENTS

| | | | | |
|---|---|---|---|---|
| GB | 2091217 A | * | 7/1982 | B05D 5/3678 |
| WO | 02/00509 A1 | | 1/2002 | |

*Primary Examiner* — Christopher R Demeree

(74) *Attorney, Agent, or Firm* — McAndrewss, Held & Malloy, Ltd.

(57) ABSTRACT

The present invention is directed to a container having increased compression strength. Embodiments of the container comprise a pair of opposing side walls, each of which may include at least one layer of corrugated board having horizontal fluting and at least one layer of corrugated board having vertical fluting. Embodiments of the container also comprise a pair of opposing end walls, each of which may include at least one layer of corrugated board having horizontal fluting and at least one layer of corrugated board having vertical fluting. Embodiments of the container may be prepared from a single blank of corrugated board and may have a bottom surface that is integral with each of the side walls and each of the end walls so as to be considered leak proof. Embodiments of the container may also be configured to be collapsible to a substantially flat arrangement.

6 Claims, 6 Drawing Sheets

(56) References Cited

U.S. PATENT DOCUMENTS 1,150,105 A * 8/1915 Emmons ..... B65D 5/4287 229/117.17
2,151,472 A 3/1939 Hubbard
2,386,905 A 10/1945 Meitzen
2,944,719 A * 7/1960 Arneson ..... B65D 5/248 229/171
3,756,499 A * 9/1973 Giebel ..... B65D 5/22 229/117.17
4,067,491 A 1/1978 Leakey et al.
4,119,265 A 10/1978 Dlugopolski
4,465,227 A 8/1984 Hood et al.
4,621,766 A * 11/1986 McClure ..... B65D 5/28 229/117.17
5,062,527 A 11/1991 Westerman
6,481,619 B1 * 11/2002 Jackson ..... B65D 5/002 206/509
6,736,309 B1 * 5/2004 Westerman ..... B65D 5/2057 229/117.05
6,837,420 B2 1/2005 Westerman et al.
7,210,614 B2 * 5/2007 Mazurek ..... B65D 5/248 229/122.32
7,225,970 B2 * 6/2007 Philips ..... B65D 5/247 229/171
7,721,941 B2 * 5/2010 Kleiner ..... B65D 5/3678 229/117.05
7,841,512 B2 * 11/2010 Westerman ..... B65D 5/6697 229/117.01
7,870,995 B1 * 1/2011 Kaltman ..... B65D 5/2047 206/485
7,883,001 B2 * 2/2011 Goodrich ..... B65D 5/324 229/122.32
8,343,024 B1 * 1/2013 Costanzo, Jr. ..... B65D 5/241 493/128
D710,691 S * 8/2014 Genender ..... D9/433
D710,692 S * 8/2014 Genender ..... D9/433
D714,139 S * 9/2014 Genender ..... D9/433
D720,989 S * 1/2015 Genender ..... D9/433
2002/0134822 A1 * 9/2002 Mills ..... B65D 5/2076 229/103.3
2004/0031842 A1 * 2/2004 Westerman ..... B65D 5/2057 229/117.06
2008/0223911 A1 * 9/2008 Mazurek ..... B65D 5/248 229/122.32
2010/0006634 A1 * 1/2010 Vogel ..... B65D 5/247 229/187
2013/0026059 A1 1/2013 Jenkins
2014/0353365 A1 * 12/2014 Nogi ..... B31B 15/00 229/122.21

* cited by examiner

CONTAINER HAVING IMPROVED COMPRESSION STRENGTH

This application is a continuation of U.S. patent application Ser. No. 14/247,543, filed Apr. 8, 2014, the entirety of which is incorporated by reference.

BACKGROUND OF THE INVENTION

1. Field of the Invention

The present invention is directed to a container, such as a portable and collapsible box-like container that may be prepared from a single blank of corrugated board, having improved compression strength.

2. Description of the Related Art

Portable and collapsible box-like containers, such as those that are made from a single blank of cardboard or fiberboard, provide a cost effective and efficient way to transport and store goods. Among other uses, these containers have found application in hospitals and operating rooms. For example, these containers may be used to bring sterilized tools and medical goods into an operating room. The same container may then be used as a receptacle for medical waste that can easily be closed and removed from the operating room for proper disposal.

For example, U.S. Pat. No. 5,062,527 to Westerman describes a foldable, leakproof multi-mode carton construction adapted for storing medical waste. The container is foldably deployed from a flat blank, which is made of paperboard, cardboard, or corrugated material. Each blank comprises a center panel, a pair of bordering width or end panels, a pair of bordering length or side panels, and four corner panels. The panels are separated by a plurality of orthogonal and diagonal fold lines that enable foldable deployment. Specifically, upon folding of the blank to create the carton, the end panels fold upward to create the end walls of the carton, the side panels fold upward to create the side walls of the carton, and the corner panels, each of which is bisected by a score line, fold inwardly so that they come to a final position adjacent to the side panels. The blank also comprises score lines in the center panel, which facilitate a "knock-down" feature enabling an assembled carton to be collapsed or flattened for storage.

U.S. Pat. No. 7,841,512 to Westerman et al. describes a folded corrugated container with reinforced quick-locking handles. The container is also foldably deployed from a flat blank of corrugated material. The blank comprises a center panel, two foldable end panels, two foldable side panels, and four foldable corner panels. The panels are separated by a plurality of orthogonal and diagonal fold lines that enable foldable deployment. Upon folding of the blank to create the container, the end panels fold upward to the create end walls of the container, the side panels fold upward to create the side walls of the container, and the corner panels, each of which is bisected by a score line, fold inwardly so that two of the corner panels are adjacent to the side panels and two of the corner panels are adjacent to the end panels. Like U.S. Pat. No. 5,062,527, the container also comprises a "knock-down" feature that enables the assembled container to be collapsed or flattened for storage.

Conventional collapsible box-like containers like the ones described above suffer from a lack of compression strength. The lack of compression strength is largely due to the fact that at least one of the side walls and/or the end walls comprises corrugated board having flutes that are arranged horizontally. Walls having horizontal fluting collapse easily when exposed to pressure from above. This lack of compression strength has resulted in a crushing or buckling at bottom surfaces of the side walls and/or end walls of the container in response to forces being applied to the top of the container. Because such downward forces are common, for example when multiple containers are stacked, the crushing or bowing of the container walls is a problem.

Conventional collapsible box-like containers like the ones described above also suffer from inconsistent interior surfaces having a plurality of exposed edges on the inside of the container. The exposed edges provide locations where the contents of the container may get snagged or caught, potentially causing damage to the contents of the container. The exposed edges may also cause a person to get snagged, particularly where the exposed edges are located in the vicinity of the handles.

Moreover, the exposed edges, and especially the lack of substantially flat interior surfaces, provide the box with an unfinished and inelegant character. Additionally, because typically only one side of the blank is colored or printed so as to conceal the natural brown color of the board on the exterior of a container, the folding of the box-like containers in the manners described above provides for interior container surfaces that predominantly retain the natural brown color of the board material.

The conventional collapsible box-like containers described above may also be subject to problems where they come unglued. This can lead to portions of the container extending into the interior of the container and, in some instances, complete failure of the container. After the corner panels are folded along a bisecting score line, as described above, the surfaces of the corner panels are typically glued together to prevent any portion of the corner panel from extending into the interior of the container. Similarly, each corner panel is typically glued to the side panel or end panel against which the corner panel is folded during creation of the container. If the glue that is used for either of these purposes is weak or becomes compromised, the corner panel or a section of the corner panel may become detached and extend into the interior of the container. If the corner panel becomes sufficiently detached, one or more of the adjacent walls of the container may fail. And if this effect occurs extensively, i.e. on multiple corner panels, the entire container can come undone.

It is an object of the present invention to provide a container that does not suffer from the disadvantages of poor compression strength and exposed internal edges.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
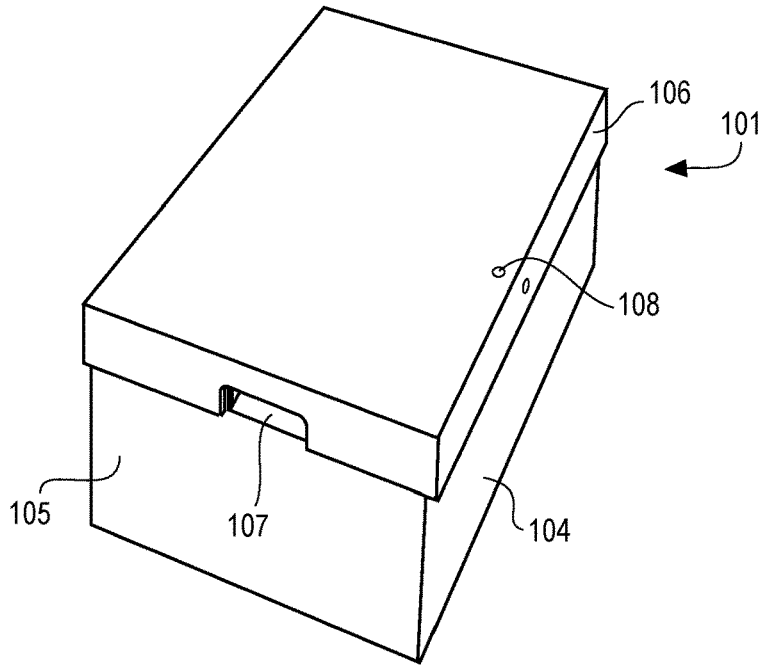
FIG. 1 is a perspective view of an embodiment of a container, having an attached lid in a closed position.

The present invention is directed to a container having increased compression strength. Embodiments of the container comprise a pair of opposing side walls, each of which may include at least one layer of corrugated board having horizontal fluting and at least one layer of corrugated board having vertical fluting. Embodiments of the container also comprise a pair of opposing end walls, each of which may include at least one layer of corrugated board having horizontal fluting and at least one layer of corrugated board having vertical fluting. Embodiments of the container may be prepared from a single blank of corrugated board and may have a bottom surface that is integral with each of the side walls and each of the end walls so as to be considered leak proof. Embodiments of the container may also be configured to be collapsible to a substantially flat arrangement.

Embodiments of the container may be configured so as to limit the exposed edges on the interior surfaces of the container, and particularly on the interior surfaces of the end walls near the handle. Embodiments of the container may be configured to provide a container having substantially flat and smooth interior surfaces. And embodiments of the container may be configured such that the interior surfaces of the container (as well as the exterior surfaces of the container) are predominantly colored or printed to as to conceal the natural brown of the board material, even where the container may be prepared from a single blank that has only one side colored or printed.

Embodiments of the container may also be configured to prevent and withstand problems relating to the failure of the adhesive, such as glue, used in holding the container in its desired configuration. Embodiments of the container may be configured to provide glue points that are unlikely to come undone, even where the glue is weak or becomes compromised. Embodiments of the container may also be configured such that the adhesion, e.g., the gluing, of numerous separate panels would have to fail before unfolding of the corner panels could occur.

At least one embodiment of the present invention is directed to a container made from a blank comprising a generally rectangular center panel; a pair of side-wall panels, each of which is integrally and foldably adjoined to each side of the center panel; a pair of end-wall panels, each of which is integrally and foldably adjoined to each end of the center panel; four foldable corner panels, each corner panel being integrally and foldably adjoined with each of a side-wall panel and an end-wall panel, and each corner panel being bisected by a diagonal score line; a pair of end-wall support panels, each end-wall support panel being integrally and foldably adjoined with an end-wall panel; and four side-wall support panels, each side-wall support panel being integrally and foldably adjoined with an end-wall support panel.

Upon the folding of the blank to create a container, each of the end-wall panels are folded upwardly to provide outer surface of the end walls of the container and each of the side-wall panels are folded upwardly to provide the outer surface of the side walls of the container. Each of the two corner panels that are integrally and foldably adjoined to each side of a particular end-wall panel fold inwardly along the diagonal score line to come to a final position in which the corner panels are adjacent to the inner surface of the end-wall panel. Then, the end-wall support panel, which is integrally and foldably adjoined with the end-wall panel, folds downwardly over the top of the folded corner panels to form a container having an improved end wall. As the end-wall support panels are folded downwardly over the top of the folded corner panels, each of the side-wall support panels folds inwardly so that they come to a final position adjacent to the inner surface of the side-wall panels to form a container having improved side walls.

By folding in this manner, the end walls may comprise a predominantly four layer construction. The end-wall panel provides a first layer. Each of the corner panels is folded along the diagonal score line to provide create two additional layers adjacent to the inner surface of the end-wall panel. Each of the corner panels, when folded in this manner, reaches almost to the longitudinal centerline of the end panel. Accordingly, the corner panels provide for two additional layers of supporting material across a large portion of the end wall. The end support panel is then folded down over the top of the corner panels to provide a final additional layer to the end wall of the container. Where the container is constructed of corrugated board, and due to the manner in which the blank is folded, at least one of the four layers of each end wall will comprise fluting in a horizontal direction and at least one of the four layers of each end wall will comprise fluting in a vertical direction. This arrangement provides the container with improved compression strength and side impact strength.

Additionally, by folding in this manner, the only exposed edge on the inner surface of each end wall is at the outer edge of the end-wall support panel, which is adjacent to the bottom surface of the container. This provides the inner surfaces of the end walls with a predominantly flat and finished character. Additionally, because the end support panel is folded down over the top of the corner panels, the side of the blank having a colored or printed surface is exposed on the interior surface of the end walls (as well as on the exterior surface of the end walls).

Upon the folding of a blank to create the container, each of the side support panels fold so as to be adjacent to the inner surface of one of the side panels. By folding in this manner, the side walls of the container comprise a predominantly two layer construction. Where the container is constructed of corrugated board, and because of the manner in which the side-wall support panels are folded, the corrugation of the side-wall support panels is in an opposite direction to the corrugation of the side-wall panels. For example, if the side-wall panels of the container comprise fluting in a horizontal direction, the side-wall support panels of the container will comprise fluting in a vertical direction. Conversely, if the side-wall panels of the container comprise fluting in a vertical direction, the side-wall support panels of the container will comprise fluting in a horizontal direction. This arrangement provides embodiments of the container with significantly improved compression strength. Additionally, by folding in this manner, the side of the blank having a colored or printed surface is exposed on the interior surfaces of the side walls (as well as on the exterior surface of the side walls).

By folding the blank so that the end support panel is folded down over the top of the corner panels to provide a final layer to the end wall and each of the side support panels are folded so as to be adjacent to the inner surface of one of the side panels, the container may be configured to prevent and/or withstand problems relating to failure of the adhesive, such as glue, used in holding the container in its desired configuration. The end support panels may be glued to each of the corner panels. The side support panels may be glued to each of the side panels. Accordingly, in order for the corner panels to unfold or become detached from the end panel, the glue holding at least the end support panel and one or more of the side support panels would have to fail. In some embodiments, this may be in addition to the glue that may be used to hold the corner panel to the end panel and/or the flue that may be used to hold the two sections of the corner panel together. For instance, the container may be configured such that the adhesive used on at least three separate panels would have to fail before unfolding of the corner panels could occur. The container may also be configured such that the adhesive used on at least three separate panels would have to fail before the corner panels could detach from the end panels. Additionally, because the end support panels and the side support panels have no forces urging them toward an unfolded position, the adhesion of those panels would be unlikely to fail and the panels would be unlikely to come undone, even where the adhesive may be weak or may become compromised. Accordingly, embodiments of the container are configured to both prevent and withstand problems related to weak or compromised adhesives.

In some embodiments, the container contains one or more score lines that run longitudinally across the center panel, each of the end panels, and each of the end support panels. The score lines are preferably located centrally between the two side panels. The score lines provide that the container is collapsible into a substantially flattened configuration. The score lines need not be identical across each of the center panel, the end panels, and the end panel supports. The score lines should, however, provide for a consistent folding of the container along a line spanning longitudinally, and preferably centrally, between the two side panels. In some embodiments, the center panel also comprises one or more score lines which run diagonally from at or near a corner of the bottom surface in toward the one or more longitudinal score lines. The one or more diagonal score lines assist in the collapsing of the container into a substantially flattened configuration.

In some embodiments, each of the end-wall panels, end-wall support panels, and foldable corner panels have cutouts. Upon the folding of the blank to create the container, the cutouts align to form a handle on each end wall of the container.

At least another embodiment of the present invention is directed to a container made of corrugated board and comprising a pair of opposed side walls, each side wall comprising at least a first layer having horizontal fluting and a second layer having vertical fluting, a pair of opposed end walls, and a bottom surface. In some embodiments, the container may be configured to be leak-proof, such as where the bottom surface is integral with each of the side walls and each of the end walls. The container may also be configured to collapse, such as to a substantially flattened arrangement, such as in response to the application of inwardly-directed forces on the opposed end walls. In some embodiments, each of the opposed end walls may also comprises a layer having vertical fluting and a layer having horizontal fluting. The end walls may also be configured such that the only exposed edge on the inner surface of each end wall may be adjacent to the bottom surface.

The advantages and features of one or more embodiments will now be described with reference to the exemplary, and therefore non-limiting, embodiments illustrated in the drawings.

Figure 2:
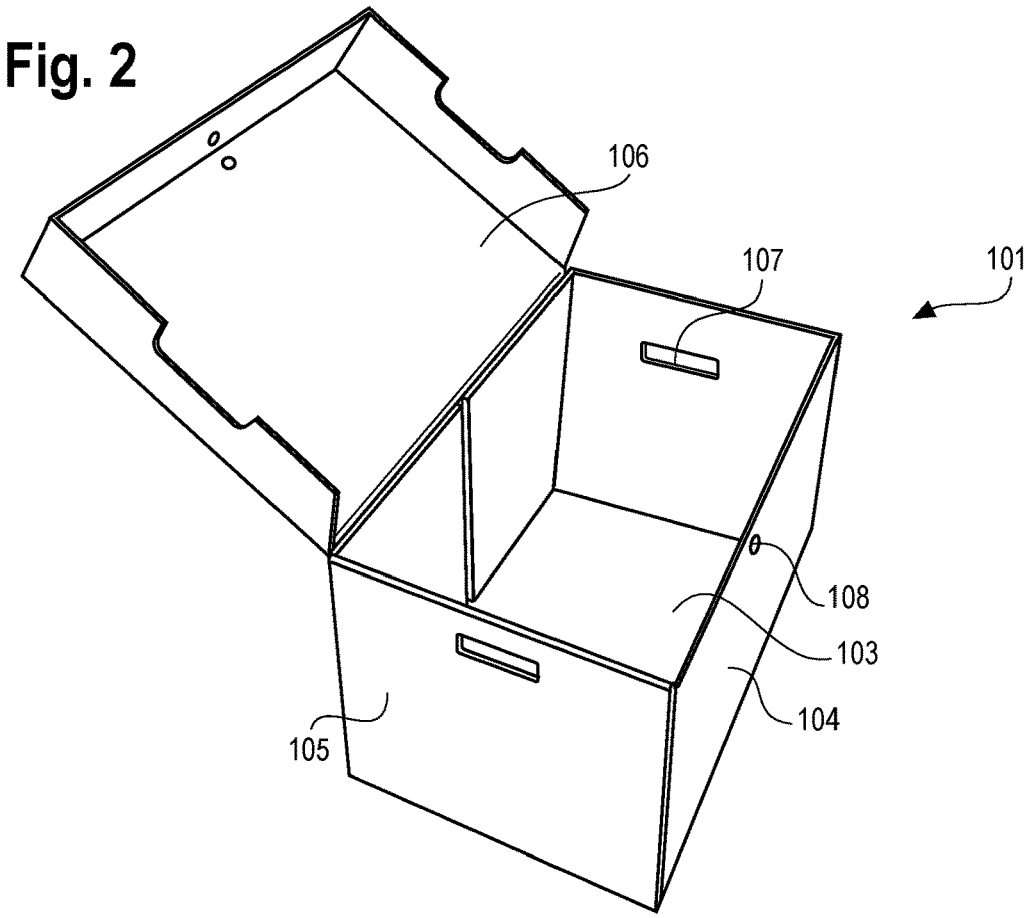
FIG. 2 is a perspective view of an embodiment of a container, having an attached lid in an open position.

Embodiments of the present invention are directed to container 101, such as that illustrated in FIGS. 1 and 2. The container comprises a bottom surface 103, a pair of opposing side walls 104 that define a length of the container, and a pair of opposing end walls 105 that define a width of the container. In some embodiments, the container also comprises a lid 106. And in some embodiments, the container also comprises handles 107. In some embodiments, the container also may comprise a locking mechanism 108 that is operable to secure the lid 106 in a closed position.

Embodiments of container 101 may be used for the storage and/or transportation of all manner of goods. In some embodiments, for example, the container 101 may be configured for the storing and/or transporting of medical materials, such as sterile and non-sterile medical and surgical supplies. In some embodiments, container 101 may also be configured for the safe storing and/or transport of medical wastes, including those comprising liquids.

Embodiments of container 101 may be configured to have a particular capacity, or maximum volume. In some embodiments, the container 101 may be configured to have a capacity between about 5 gallons and about 50 gallons. For example, the container 101 may be configured to have a 10 gallon capacity, alternatively the container may be configured to have a 12 gallon capacity, alternatively the container may be configured to have a 14 gallon capacity, alternatively the container may be configured to have an 18 gallon capacity, alternatively the container may be configured to have a 20 gallon capacity, alternatively the container may be configured to have a 24 gallon capacity, alternatively the container may be configured to have a 30 gallon capacity, and alternatively the container may be configured to have a 40 gallon capacity.

Embodiments of container 101 are made of corrugated board such as corrugated fiberboard. Corrugated fiberboard consists of a paper-based material having one or more fluted sheets and one or more flat liner sheets. In at least one embodiment, the corrugated board used as the material for container 101 is a double-face corrugated sheet, i.e. a corrugated sheet consisting of one fluted sheet sandwiched between two flat outer sheets, also known as a single wall corrugated board. The corrugated board may comprise flutes of any desired designation, such as A, B, C, E, or F. The strength of the corrugated board material may be selected depending on the desired uses for the container. Due to the strength-enhancing features of embodiments of the container 101, the container may comprise corrugated board materials of lower-strength (and accordingly lower cost) than those that would be suitable for a conventional box configured to withstand the same forces.

Figure 7:
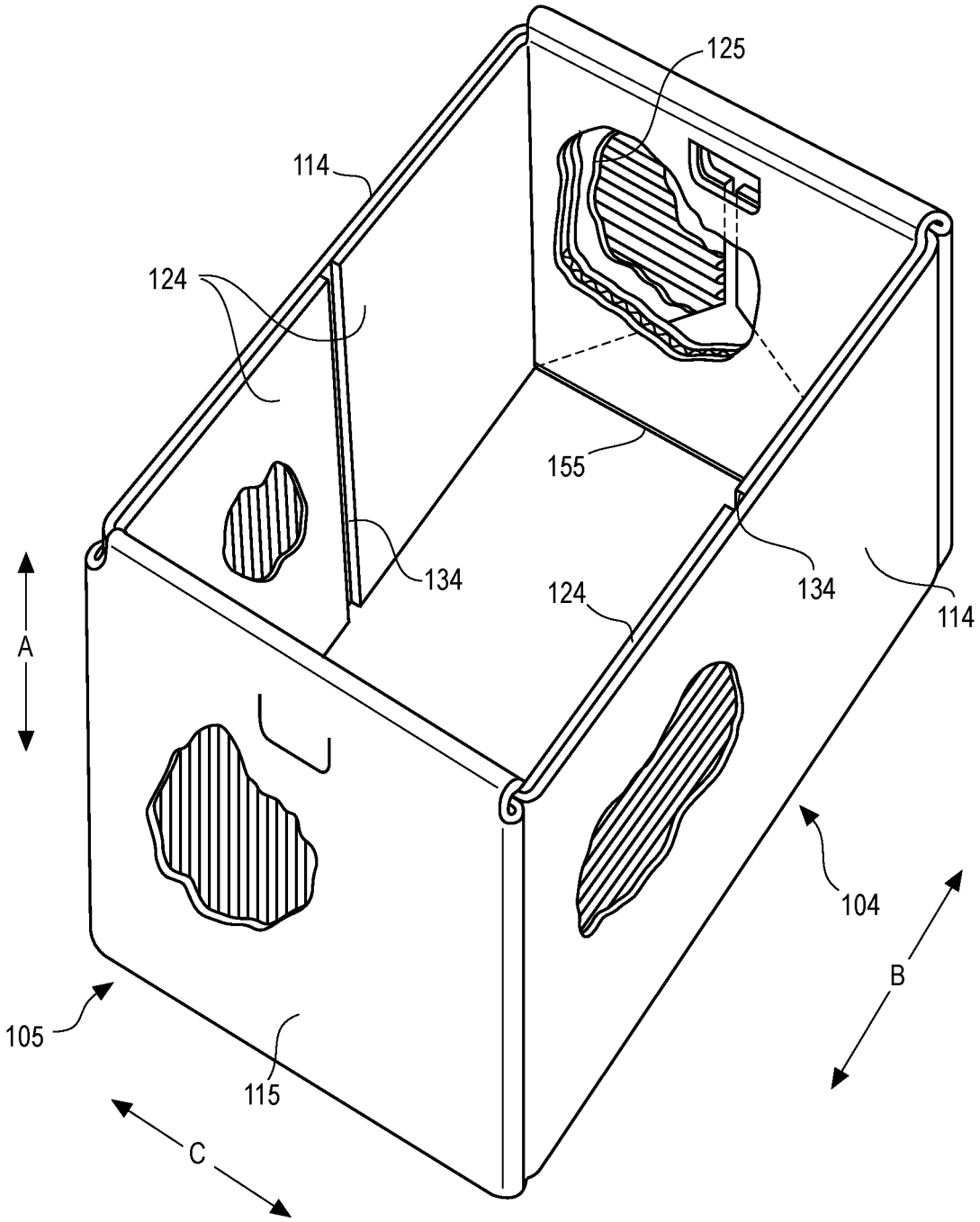
FIG. 7 is a perspective view, partly in section, of an embodiment of a container having side walls and end walls that provide the container with improved compression strength.

Embodiments of container 101, such as that illustrated in FIG. 7, have side walls 104 that each comprises at least a first layer 114 of corrugated board having one of horizontal fluting and vertical fluting and a second layer 124 of corrugated board having fluting that is in a direction opposite to that of the first layer. For example, in the embodiment illustrated in FIG. 7, the first layer 114 comprises corrugated board having horizontal fluting and the second layer 124 comprises corrugated board having vertical fluting. It is also contemplated, however, that the first layer 114 may comprise vertical fluting and the second layer 124 may comprise horizontal fluting. This may be achieved, for instance, by reversing the direction of the corrugation in the blank used to prepare the container 101.

Each layer 114,124 need not comprise a single, continuous panel. In the embodiment illustrated in FIG. 7, for example, the second layer 124 comprises two panels, referred to herein as side-wall support panels 220, that each span a portion of the side wall 104. Nor must each layer 114,124 span either the entire height of the side wall or the entire length of the side wall. For the side wall 104 to be considered as comprising a first layer 114 and a second layer 124, however, each layer should span a substantial portion of the side wall, such that the presence of each layer has a measurable effect on the compression strength of the side wall. For example, in the embodiment illustrated in FIG. 7, the two panels 220 that together comprise the second layer 124 span across the length of the side wall except for a small central gap 134 where the panels meet.

While the size of the gap 134 can vary, it is desirable to keep the gap relatively small so that the second layer 124 provides a significant enhancement of the compression strength of the side wall 104. It is also desirable to keep the gap 134 relatively small in order provide that the exposed edges 144 of the side wall support panels 220 lie alongside one another. This limits the potential interference of the exposed edges 144 on the loading and unloading of the container 101 as well as the interaction between the exposed edges and the contents of the container. It also provides a side wall 104 having a substantially flat interior surface. Further, the interior surface of the side wall 104 may be predominantly a colored or printed board surface (in addition to an exterior surface of the side wall, which may also be a colored or printed board surface despite being prepared from a blank having coloring or printing on only one side).

In the embodiment illustrated in FIG. 7, the horizontal fluting of the first layer 114 will increase the strength of the side wall in the direction labeled B, while the vertical fluting of the second layer 124 will increase the strength of the side wall in the direction labeled A. By providing a side wall 104 having both a layer comprising horizontal fluting and a layer comprising vertical fluting, the container 101 is provided with a side wall having considerable strength in both directions, i.e. along its height and along its length.

Embodiments of container 101 may also have end walls 105 that each comprises at least a first layer 115 of corrugated board having one of horizontal fluting and vertical fluting and a second layer 125 of corrugated board having fluting that is in a direction opposite to that of the first layer. In the embodiment illustrated in FIG. 7, for example, the first layer 115 comprises vertical fluting and the second layer 125 comprises horizontal fluting. It is also contemplated, however, that the first layer 115 may comprise horizontal fluting and the second layer 125 may comprises vertical fluting. This may be achieved, for instance, by reversing the direction of the corrugation in the blank used to prepare the container 101.

Each layer 115,125 need not comprise a single, continuous panel. In the embodiment illustrated in FIG. 7, for example, the second layer 125 comprises two panels, here being a portion of a folded corner panel 206, that each span a portion of the end wall 105. Nor must each layer 115,125 span either the entire height of the end wall or the entire width of the end wall. For example, in the embodiment illustrated in FIG. 7, the upper portions of the two panels 206 that together comprise the second layer 125 span the width of the end wall with the exception of a central gap between the panels. Additionally, in the embodiment illustrated in FIG. 7, the two panels 206 that together comprise the second layer 125 do not span the entire height of the end wall 105. Nevertheless, the panels 206 together may sufficiently cover a surface area of the end wall 105 so as to comprise a second layer 125.

In the embodiment illustrated in FIG. 7, the vertical fluting of the first layer 115 will increase the strength of the container in the direction labeled A, while the horizontal fluting of the second layer 125 will increase the strength of the container in the direction labeled C. By providing an end wall 105 having both a layer of corrugated board comprising horizontal fluting and a layer of corrugated board comprising vertical fluting, the container 101 comprises an end wall having considerable strength in both directions, i.e. along its height and along its width.

Some embodiments of container 101 have end walls 105 that comprise additional layers. The embodiment illustrated in FIG. 7, for example, has an end wall 105 that comprises both a third layer 135 and a fourth layer 145. The additional layers may have either horizontal or vertical fluting. In the embodiment illustrated in FIG. 7, both of the third 135 layer and the fourth layer 145 comprise vertical fluting. This embodiment, which comprises end walls having three layers of vertical fluting, has considerable strength in the direction labeled A.

Additionally, in some embodiments such as that illustrated in FIG. 7, the only exposed edge 155 on the inner surface of each end wall 105 is adjacent to the bottom surface of the container 103. By providing only a single exposed edge 155 on the inner surface of each end wall 105, the container 101 may be configured to prevent interaction between exposed edges and the contents of the container, which can potentially cause damage to the contents. The single exposed edge 155 also prevents interference of exposed edges with a person, such as may occur where exposed edges are located on an end wall, and particularly where exposed edges are located in the vicinity of the handles 107. This configuration also provides the inner surfaces of the end walls 105 with a substantially flat and finished appearance. Further, the interior surfaces of the end wall 105 may be predominantly a colored or printed board surface (in addition to an exterior surface of the end wall, which may also be a colored or printed board surface despite being prepared from a blank having coloring or printing on only one side).

The bottom surface 103 of the container may be integral with each of the side walls 104 and each of the end walls 105. For example, in some embodiments, the container 101 may be formed from a single blank 201. Where the bottom surface of the container 103 is integral with the walls of the container 104, 105, the container may be considered leak-proof.

The container may also be configured to collapse, such as to a substantially flattened arrangement, in response to the application of inwardly-directed forces on the opposed end walls 105. In this embodiment, the container comprises one or more score lines 109 that run longitudinally across the bottom surface of the container 103 and one or more score lines 109 that run vertically up each end wall of the container 105. The score lines 109 are desirably located approximately centrally between the opposing side walls 104. The score lines 109 provide for a consistent folding of the container across the length of the container 101. The bottom surface of the container 103 may also comprise a number of additional score lines 111 that run diagonally from at or near a corner of the bottom surface inward toward a central score line 109 on the bottom surface. The one or more diagonal score lines 111 assist in the collapsing of the container into a substantially flattened configuration.

Figure 8:
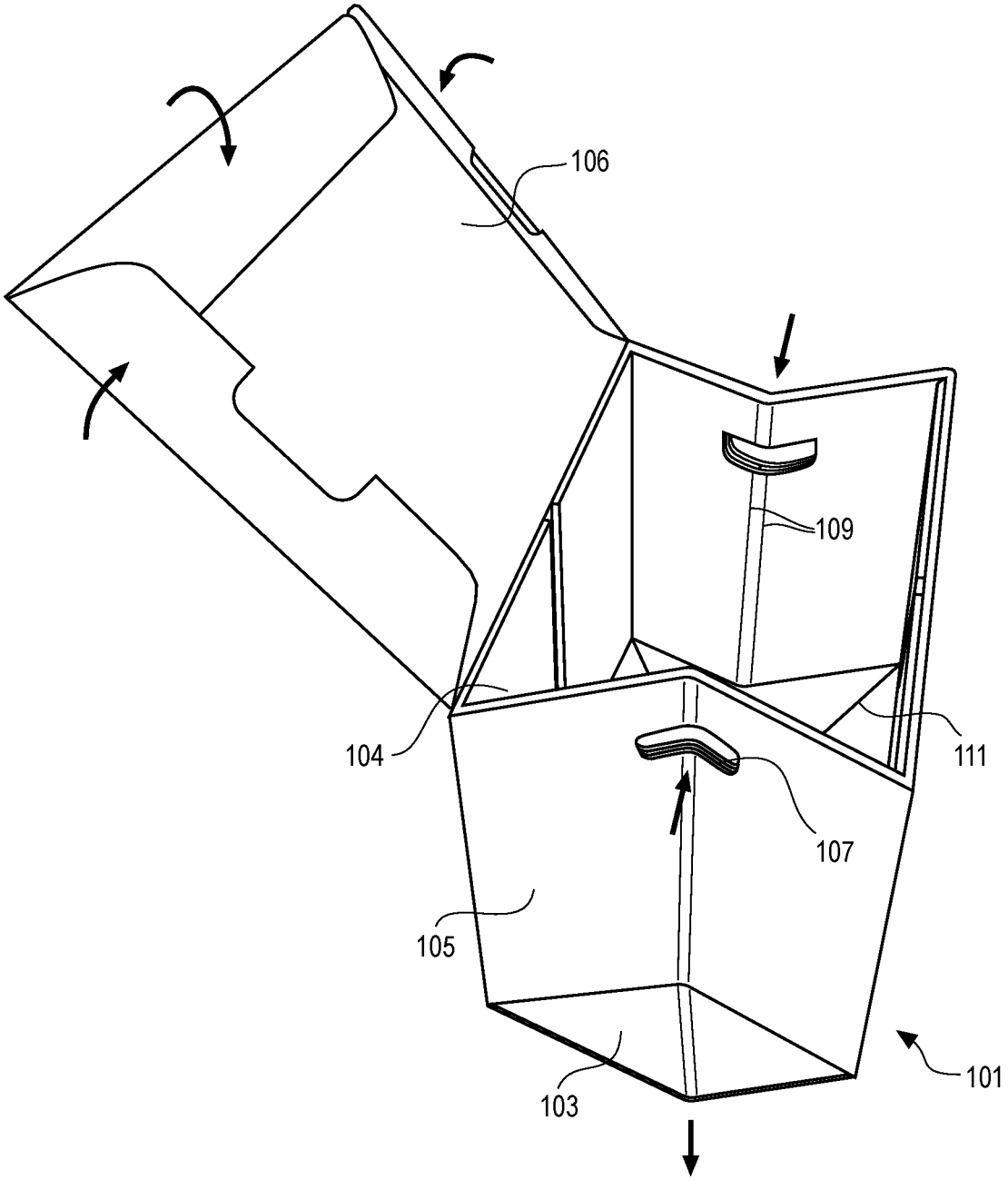
FIG. 8 is a perspective view of an embodiment of a container that is collapsible to a substantially flat arrangement.

The collapsing of an embodiment of the container is illustrated in FIG. 8. When an inward force is applied to the end walls 105, they fold about the vertical score line or lines 109. When this occurs, the bottom surface of the container 103 folds about the longitudinal score line 109 such that the bottom surface drops downward below the bottom edges of the side walls 104 and the end walls 105. The combination of these actions brings the opposing side walls of the container 104 in to close proximity with one another, rendering the container substantially flat. Once the container 101 is collapsed so as to be substantially flat, it can be efficiently stored and/or transported without requiring much space. The container 101 can easily and reversibly be collapsed and re-expanded in order to suit a user's needs.

The container 101 may also comprise a lid 106. The lid 106 comprises a top surface and flaps that are configured to extend downward over the side walls 104 and end walls 105 of the container. These flaps may be referred to as side flaps and end flaps. In some embodiments, the lid 106 may be affixed to the container 101. The lid 106 may be affixed to the container 101 through any conventional means, such as adhesives, stapling, and the like. Desirably, the lid 106 is affixed to a side wall 104 of the container. For example, as illustrated in FIG. 2, a side flap of the lid 106 is affixed to the exterior surface of a side wall 104 of the container. Where this is the case, the side of the container to which the lid is affixed may be referred to as the back of the container and the opposite side may be referred to as the front of the container.

The lid 106 may also be configured to be collapsible. For instance, in the embodiment illustrated in FIG. 8, the front flap and both end flaps of the lid are be capable of folding inward so that the lid 106 becomes substantially flat. This may be particularly useful, for example, where the lid 106 is affixed to a container 101 that is configured to be collapsible, as illustrated in FIG. 8. As the container is collapsed, the lid may fold away from the top of the container so as to be in close proximity with the rear wall to which it is attached. And the flaps of the lid may fold inward, thereby rendering the combination of the collapsed container and the lid substantially flat.

The container 101 may also comprise a locking mechanism 108, by which the lid 106 may be secured in a closed position. For example, the container illustrated in FIGS. 1 and 2 comprises a locking mechanism 108 that includes a cutout on the front wall of the container, i.e. on the side wall opposite from the side wall to which the lid 106 is affixed. The cutout on the front wall coordinates with a cutout on the front flap of the lid, such that, when the lid is in a closed position, the coordinating cutouts on the side wall and the front flap of the lid form a first opening. The lid also comprises a second opening, such as a cutout on the upper surface of the lid. Using this embodiment of the locking mechanism 108, one may secure the lid 106 in a closed position by passing a cable tie, a zip-tie, or the like through both the first opening and the second opening and then fastening the tie. In embodiments where the lid 106 may not be attached to the container 101, the container may have more than one locking mechanism 108. For example, the container 101 may comprise locking mechanisms on each opposing side of the container or on each opposing end of the container.

The container 101 may also comprise handles 107. The handles 107 are desirable located at each end wall 105. The handles 107 may take a number of forms. In the embodiment illustrated in FIG. 2, for example, the handles 107 may comprise a pair of openings configured for gripping. The openings are desirably located at the upper central region of each end wall 105. In some embodiments, a flap of material from the outer layer of the end wall 105 may not be fully removed and rather may reside within the opening. Thus, when one grips the container using the opening, one may push the flap of material against the upper surface of the opening. In this way, a user's hand is prevented from contacting the edges of the layers that may otherwise be exposed on the upper surface of the opening. Rather the user's hand contacts the smooth surface of the material that has been pressed against the upper surface of the opening. This may provide a handle with an increased level of comfort.

Figure 3:
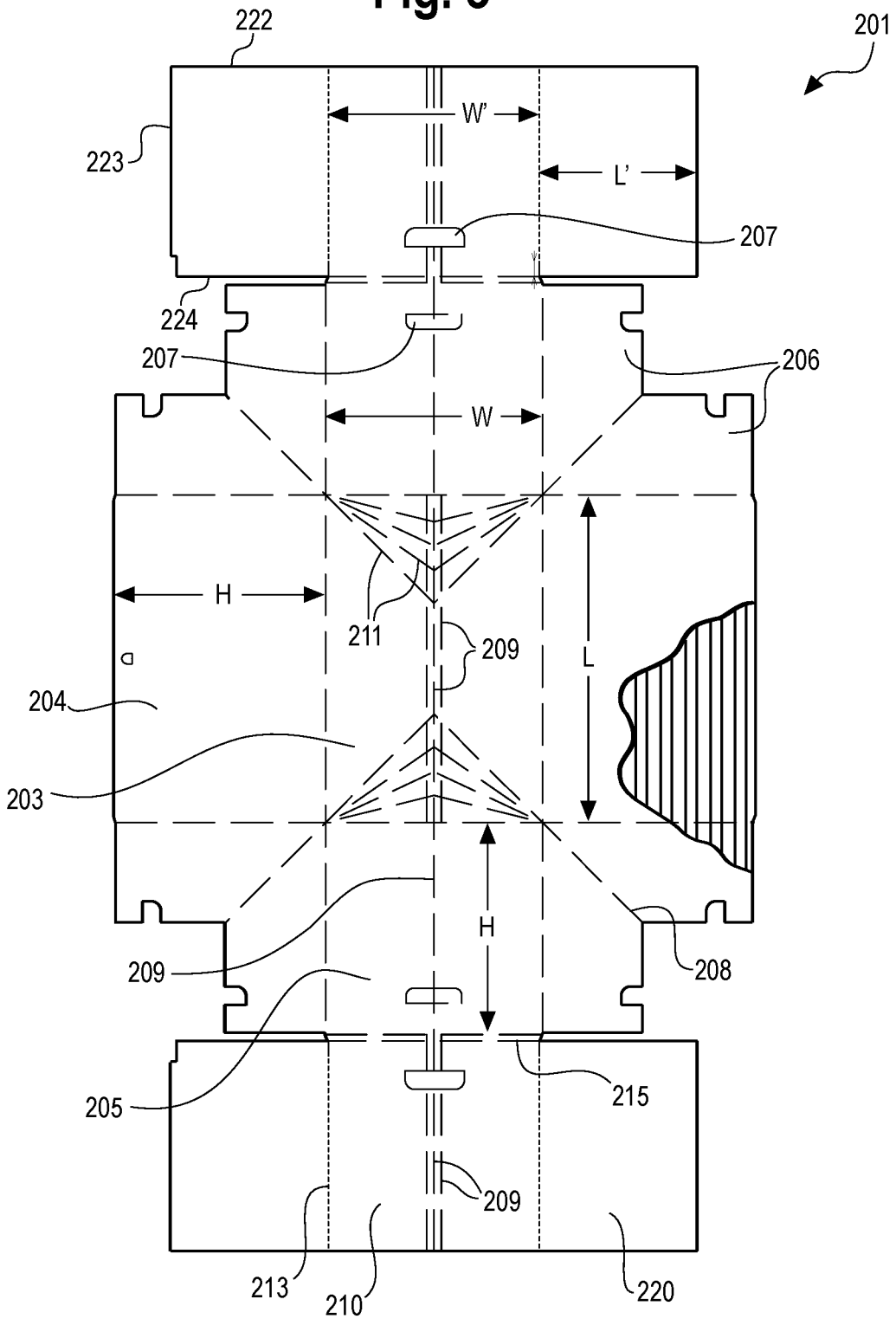
FIG. 3 is a top plan view of an embodiment of a blank, such as may be used to form a container.

As described above, the container is preferably made from cardboard, paperboard, fiberboard, or another similar material. In some embodiments, the container 101 is made from a corrugated fiberboard material. The container may be prepared by folding a single flat blank 201, which is typically cut from a sheet-stock of the desired material. Because the blank 201 is a single piece cut from a sheet-stock of the desired material, the corrugation of the blank will run in a single direction, as is illustrated in FIG. 3. In some embodiments, one side of the blank 201 may be colored or printed. A colored or printed blank 201 may be used to provide a container having an improved visual appearance. For example, the blank 201 illustrated in the Figures may be colored on its underside, such that the folding of the blank to produce a container 101 provides a container having side walls 104 and end walls 105 whose exterior surfaces are colored.

Embodiments of the container 101 may be described with reference to the structure of the blank 201.

As illustrated in FIG. 3, the blank 201 comprises a generally rectangular center panel 203 having a width W spanning between a pair of opposing sides and a length L spanning between a pair of opposing ends. Each side of the center panel 203 is integrally and foldably adjoined with a side panel 204. Each end of the center panel 203 is integrally and foldably adjoined with an end panel 205. The two side panels 204 and the two end panels 205 are preferably configured to extend about a defined distance H from the center panel such that, when folded upward, they form walls having a substantially consistent height. Four integral and diametrically spaced apart corner panels 206 interconnect the center panel 203, the side panels 204, and the end panels 205. Each corner panel 206 is bifurcated by a score line 208, about which the corner panel may fold.

Figure 6:
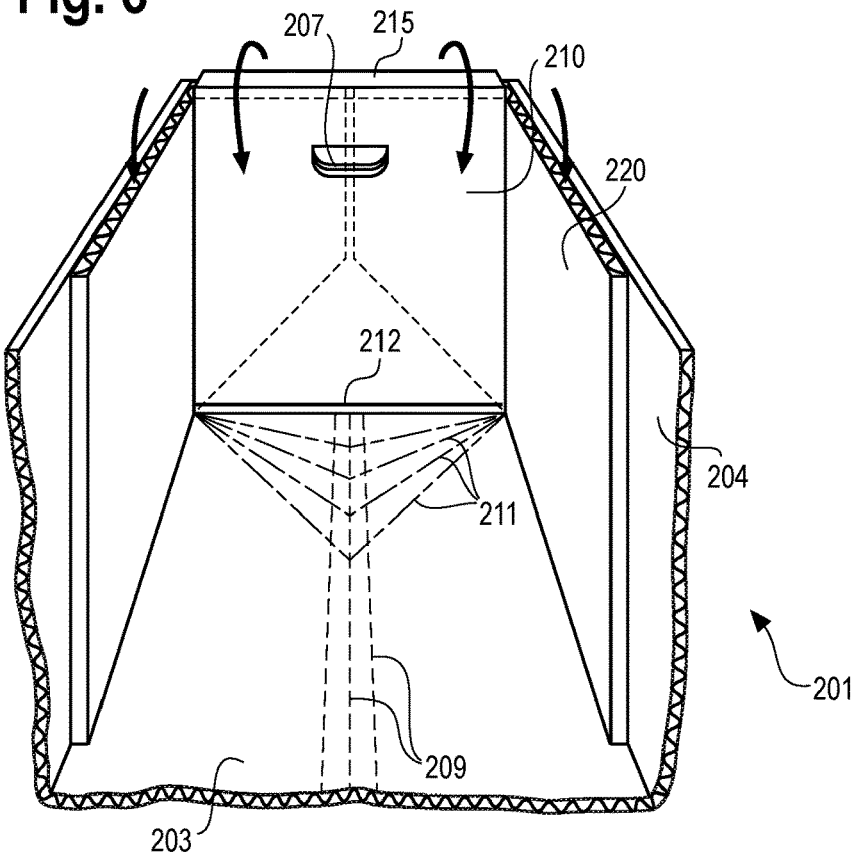
FIG. 6 is a perspective view, partly in section, of a blank being folded to form a container in accordance with an embodiment of the present invention.

The blank 201 also comprises a pair of end-wall support panels 210. A first end-wall support panel 210 is integrally and foldably connected to an outer edge of one of the two end panels 205. A second end-wall support panel 210 is integrally and foldably connected to an outer edge of the other of the two end panels 205. Each end-wall support panel comprises an outer edge 212 and a pair of sides 213. Each end-wall support panel 210 is desirably attached to an end panel 205 through a small strip 215 having a first foldable score line where the strip meets the end-wall support panel and a second foldable score where the strip meets the end panel. This small strip 215 provides that the end-wall support panel 210 may fold over the top of the end panel 205 and the folded corner panels 206 such that the outer edge 220 of the end-wall support panel is located on the interior of the resulting container, as illustrated in FIG. 6.

The end-wall support panels 210 may each have dimensions that are substantially similar to the dimensions of the end panels 205. As illustrated in FIG. 3, an end-wall support panel 210 may extend a distance H' away from the small strip 215 that connects it with the end panel 205. To ensure that the end-wall support panel 210 may properly fold into the interior of the container without interference from the bottom surface, the distance H' is desirably less than the distance H. Where the distance H' is only slightly less than the distance H, the outer edge 212 of the end-wall support panel may desirably be located adjacent to the bottom surface of the container when the blank 201 is folded to prepare the container. Additionally, the width W' of the end-wall support panel 210 is desirably slightly less than the width of the center panel W, in order to ensure that the end-wall support panel may properly fold into the interior of the container without interference from the side panels 204.

The blank 201 also comprises side-wall support panels 220. Each side-wall support panel 220 is integrally and foldably connected to a side 213 of the end-wall support panel 210. Accordingly, as illustrated in FIG. 3, the blank 201 comprises four side-wall support panels 220. Each side-wall support panel comprises an outer edge 222, a side edge 223, and an inner edge 224. Like the end-wall support panel 210 to which it is connected, each side-wall support panel desirably spans a distance H' between its outer edge 222 and its inner edge 224. The side edge 223 of the side-wall support panel extends a distance L' away from the score line that connects it to the end-wall support panel 210. L' is desirably slightly less than one half of the length of the center panel L. This relationship provides that the side-wall support panels 220 will combine to cover most of the length of the container side walls without interfering with one another.

In some embodiments, the blank 201 also comprises one or more score lines 209. The score lines run lengthwise across the center panel 203, each of the end panels 205, and each of the end-wall support panels 210. The score lines 209 are preferably located centrally between the two side panels 204. The score lines need not be identical across each of the center panel 203, the end panels 205, and the end-wall support panels 210. The score lines 209 should, however, provide for a consistent folding of the container along a line spanning lengthwise and preferably centrally between the two side panels 204. The center panel may also comprise one or more score lines 211, which run diagonally from at or near a corner of the center panel 203 in toward the one or more longitudinal score lines 209. The one or more diagonal score lines 211 assist in the collapsing of the container into a substantially flattened configuration.

Figure 5:
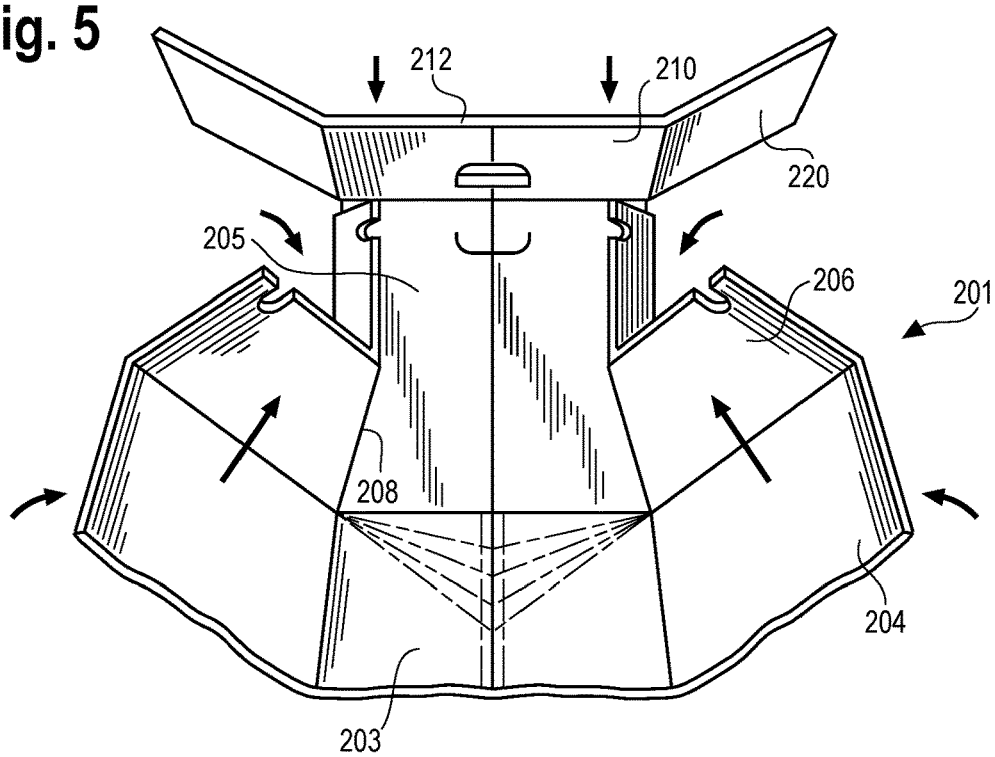
FIG. 5 is a perspective view of a blank being folded to form a container in accordance with an embodiment of the present invention.

In some embodiments, the blank also comprises handle cutaways 207. The handle cutaways 207 are located on each of the end panels 205, each of the corner panels 206, and each of the end-wall support panels 210. Each of the corner panels 206 comprises a portion of a handle cutaway 207 which is configured to align with the handle cutaways on the end panel 205 when the corner panel 206 is folded so as to be adjacent to the end panel 205, such as illustrated in FIG. 5. The handle cutaways on the end-wall support panel 210 are configured to align with the handle cutaways on the end panel 205 when the end-wall support panel is folded inward, such as illustrated in FIG. 6.

In those embodiments in which the container comprises a lid 106, the lid 106 is desirably prepared from a separate blank which may or may not comprise the same material as blank 201. For example, it may be desirable to prepare the lid 106 from a board material having lower strength and thus bearing a lower cost.

Figure 4:
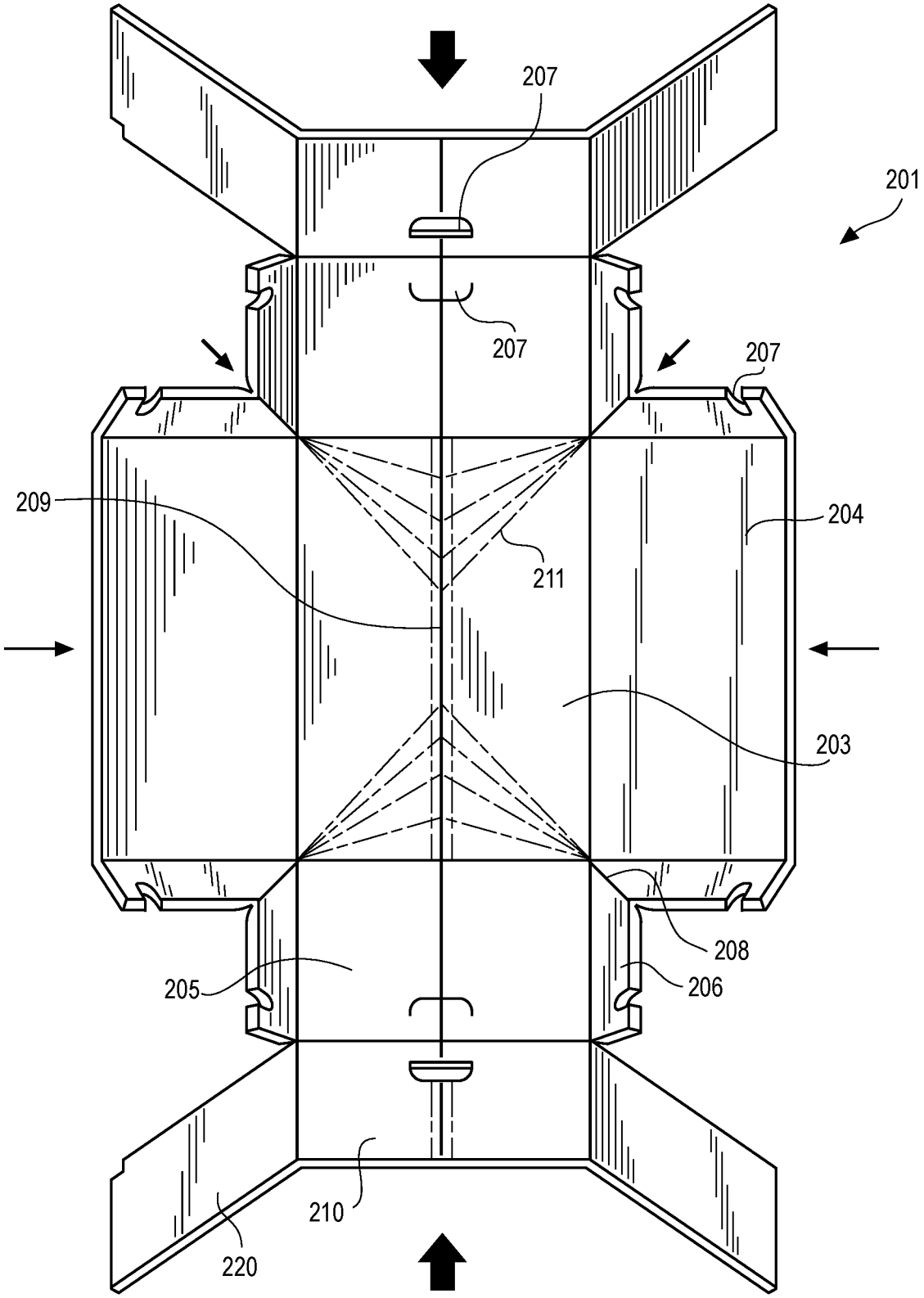
FIG. 4 is a top plan view, partly in perspective, of a blank being folded to form a container in accordance with an embodiment of the present invention.

The preparation of a container 101 from the blank 201 is illustrated in FIGS. 4, 5, and 6. As illustrated in FIG. 4, the side panels 204 and the end panels 205 are folded upward along each of the foldable connections with the center panel 203. This folding provides a container having a bottom surface, a pair of opposing side walls, and a pair of opposing end walls. As each of the panels is folded upward, the corner panel 206 that spans between a side panel 204 and an end panel 205 is pushed inward at its score line 208, as illustrated in FIGS. 4 and 5. As the corner panels fold about the score line 208, they are brought into a final position at which each corner panel 206 is adjacent to the end panel 205. This is illustrated, for example, in FIGS. 5 and 6.

The folding of the two corner panels 206 at each end to this final position may provide each end wall of the resulting container with a first additional layer, the first additional layer comprising the portions of the corner panels that are proximate to the end panel 205 in the blank 201. The folding of the corner panel 206 to this final position may also provide the end wall of the resulting container with a second additional layer, the second additional layer comprising the portions of the corner panels that are proximate to each of the side panels 204 in the blank 201. The first additional layer abuts the end wall panel 205 and is sandwiched between the end wall panel 205 and the second additional layer. Because of the manner in which the corner panels 206 are folded, the second additional layer comprises fluting that is in a direction opposite to that of the end wall panel 205. For example, in the illustrated embodiment, the second additional layer produced by the folding of the corner panel 206 comprises fluting that runs horizontally across the width of the end wall while the end wall panel 205 comprises fluting that runs vertically across the height of the end wall.

Where the corner panels 206 comprise handle cutaways 207, folding of the corner panels in the manner described above results in an alignment of the handle cutaway portions of the corner panels with the handle cutaway of the end panel 205.

Once the end walls and the side walls have been formed as described above, the end-wall support panels 210 and the side-wall support panels 220 are folded into the interior of the container. As illustrated in FIGS. 5 and 6, each end-wall support panel 210 is folded over the top of the end wall panel 205 and the folded corner panels 206, such that the end-wall support panel becomes the innermost layer of the end wall 105. As previously described, where the distance H' is only slightly less than the distance H, the outer edge 212 of the end-wall support panel may desirably be located adjacent to the bottom surface of the container. The end-wall support panel 210 thus serves to conceal the additional layers, and the exposed edges of the additional layers, provided by the folding of the corner panels 206. With the folding of the end-wall support panel 210 in this manner, the underside of the end-wall support panel 210 of the blank becomes exposed as the interior surface of the container end wall 105. Where, for example, the underside of the blank is colored, this provides the container end wall 105 with a colored interior surface.

As the end-wall support panel 210 is folded over the top of the end wall panel 205 and the folded corner panels 206, the two side-wall support panels 220 that are connected with each side 213 of the end-wall support panel 210 are brought into the interior of the container to a position where each side-wall support panel abuts a side wall panel 204. The side-wall support panels 220 from each end combine to provide a container side wall with an additional layer. As previously described, where L' is slightly less than one half of the length of the center panel L, the side-wall support panels 220 from each end combine to create an additional layer that covers most of the length of a container side wall without interfering with one another.

Because of the manner in which the side-wall support panels 220 are folded into the interior of the container, the layer provided by the side-wall support panels comprises fluting that is in a direction opposite to that of the side wall panel 204. For example, in the illustrated embodiment, the additional layer produced by the folding of the side-wall support panels 220 comprises fluting that runs vertically across the height of the side wall while the side wall panel 204 comprises fluting that runs horizontally across the length of the side wall.

With the folding of the side-wall support panels 220 in this manner, the underside of the side-wall support panels 220 of the blank becomes exposed as the interior surface of the container side wall 104. Where, for example, the underside of the blank 201 is colored, this provides the container side wall 104 with a colored interior surface.

Where the container 101 comprises a lid 106, the lid is desirably prepared from a separate blank and affixed to the container after the container has been prepared as described above.

Boxes and containers made of cardboard, paperboard, fiberboard, and the like preferably possess sufficient compression strength so that they do not get deformed or crushed when stacked one above the other, such as is often the case during transit or in storage. Accordingly, the compression strength of a box or container is an important characteristic of a container. One factor that determines the compression strength of a container is the strength of the board material which makes up the container. As the strength of a board material increases, however, the cost of that board material also increases. Accordingly, it is an object of the embodiments of the present invention to provide a container having an increased compression strength over a comparative container made of a board material having an equivalent or higher board strength.

The compression strength of a container is determined by compression strength testing, also known as a container compression test or top down compression test. In a top down compression test, the container is placed on a flat platform and a flat compression plate is pressed down on the top of the container. A load sensor is used to measure the force applied by the compression plate. The force applied to the compression plate is increased until the container buckles or collapses. The highest force withstood by the container before it undergoes buckling or collapse to a predetermined degree, known as the maximum deflection, is measured.

A test sample of an embodiment of the container of the present invention was prepared from the blank 201 shown in FIG. 3, as described above. The blank comprised a sheet of single wall corrugated fiberboard having a board combination of 35-23-35. The fluting of the blank was of C-grade. The test sample container was subjected to compression strength testing as described above. It was found that the test sample container was able to withstand a load of 1,253 pounds before compressing 0.3 inches, which was considered to be the maximum deflection for this test.

A conventional container was obtained from Wes-Pak, Inc. The conventional container was prepared from a blank that did not contain either of the end-wall support panels 210 or side-wall support panels 220. The conventional container was prepared from a sheet of single wall corrugated fiberboard having a board combination of 42-33-42 and a C-grade fluting. The conventional container was subjected to the same compression strength testing as the test sample container and was found to have a compression strength of 482 pounds before compressing 0.3 inches, which was considered to be the maximum deflection for this test.

Accordingly, even though the conventional container is made of a board material having a higher strength, such as is measured by an edge compression strength test (ECT), the container prepared in accordance with an embodiment of the present invention was found to have a compression strength that is about 160% stronger than the conventional container. Using this data, it would be expected that a test sample container prepared from a single wall corrugated fiberboard having a board combination that is equivalent to that of the conventional container (42-33-42), would have a compression strength that is about 175% to 180% stronger than the conventional container. Accordingly, embodiments of the present invention have been shown to provide a container having significantly increased compression strength when compared to conventional containers.

Using a similar procedure, the side impact strength and end impact strength of a container may also be tested. While generally not as important as the compression strength, side impact strength and/or end impact strength may still be important characteristics of a container.

Embodiments of the container of the present invention comprise an end wall having at least one layer comprising corrugated board with fluting in a vertical direction and at least one layer comprising corrugated board with fluting in a horizontal direction. Accordingly, in addition to having an improved compression strength, embodiments of the container are also predicted to have an improved side impact strength relative to conventional containers, such as the conventional boxes described above, that are made of the same board material. Similarly, embodiments of the container of the present invention comprise a side wall having at least one layer comprising corrugated board with fluting in a vertical direction and at least one layer comprising corrugated board with fluting in a horizontal direction. Accordingly, in addition to having an improved compression strength, embodiments of the container are also predicted to have an improved end impact strength relative to conventional containers, such as the conventional boxes described above, that are made of the same board material.

It can be seen that the described embodiments provide a unique and novel container that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A container made from a single blank, the blank comprising:

a generally rectangular center panel having ends and sides;

a pair of side panels, each side panel being integrally and foldably adjoined with a side of the center panel;

a pair of end panels, each end panel being integrally and foldably adjoined with an end of the center panel;

four foldable corner panels, each corner panel integrally and foldably adjoined with each of a side panel and an end panel, and each corner panel comprising a diagonal score line;

a pair of end support panels, each end support panel being integrally and foldably adjoined with an end panel; and four side support panels, each side support panel being integrally and foldably adjoined with an end support panel;

wherein, upon the folding of the blank to create the container, each of the two corner panels that are integrally and foldably adjoined to an end panel fold so as to be adjacent to the inner surface of the end panel, and the end support panel that is integrally and foldably adjoined with the end panel folds down over the top of the folded corner panels to form each end wall of the container, such that each end wall comprises a predominantly four layer construction;

wherein, upon folding of the blank to create the container, each of the side support panels folds so as to be adjacent to the inner surface of a side panel to form the side walls of the container, such that each side wall comprises a predominantly two layer construction; and wherein the blank comprises corrugated board and wherein one layer of each side wall comprises horizontal fluting and the other layer of each side wall comprises vertical fluting, providing the container with improved compression strength.

2. The container of claim 1, wherein at least one layer of each end wall comprises horizontal fluting and at least one layer of each end wall comprises vertical fluting.

3. The container of claim 1, the blank further comprising one or more score lines that run longitudinally across the center panel, each of the end panels, and each of the end support panels.

4. The container of claim 3 wherein the center panel of the blank also comprises one or more score lines which each run diagonally from at or near a corner of the bottom surface inward to the one or more longitudinal score lines.

5. The container of claim 4 wherein, upon the folding of the blank to create the container, the score lines facilitate the collapse of the container into a substantially flattened configuration.

6. The container of claim 1 wherein each of the end panels, end support panels, and foldable corner panels have cutouts and wherein, upon the folding of the blank to create the container, the cutouts align to form a handle on each end wall of the container.

* * * * *